US005421497A

United States Patent [19]

Gilmore

[11] Patent Number: 5,421,497

[45] Date of Patent: Jun. 6, 1995

[54] VARIABLE POSITION HANDGUN HOLSTER

[76] Inventor: W. Riley Gilmore, 2924 E. 73rd St., Tulsa, Okla. 74136

[21] Appl. No.: 112,184

[22] Filed: Aug. 26, 1993

[51] Int. Cl.[6] ..... F41C 33/02

[52] U.S. Cl. ..... 224/198; 224/192; 224/912

[58] Field of Search ..... 224/191, 192, 193, 196, 224/197, 198, 200, 243, 244, 911, 912, 238, 240, 242, 252, 913

[56] References Cited

U.S. PATENT DOCUMENTS

| | | | |
|---|---|---|---|
| 2,985,347 | 5/1961 | Neve | 224/197 |
| 3,107,833 | 10/1963 | Vaughn | 224/197 |
| 3,261,519 | 7/1966 | Horne | 224/198 |
| 3,781,121 | 12/1973 | Gross . | |
| 3,915,361 | 10/1975 | Perkins | 224/911 |
| 3,994,597 | 11/1976 | Calder et al. . | |
| 4,105,282 | 8/1978 | Schael . | |
| 4,348,109 | 9/1982 | Auterson . | |
| 4,417,814 | 11/1983 | Doliber . | |
| 4,504,001 | 3/1985 | Nichols | 224/911 |
| 4,584,776 | 4/1986 | Shepherd . | |
| 4,828,154 | 5/1989 | Clifton, Jr. | 224/253 |
| 4,874,118 | 10/1989 | Parlante | 224/198 |
| 4,915,273 | 4/1990 | Allen | 224/913 |
| 4,925,075 | 5/1990 | Rogers | 224/912 |
| 4,971,236 | 11/1990 | Grummet | 224/193 |
| 5,018,653 | 5/1991 | Shoemaker | 224/253 |
| 5,029,741 | 7/1991 | Easter | 224/913 |
| 5,048,735 | 9/1991 | McCormick | 224/244 |
| 5,090,805 | 2/1992 | Stawarz . | |
| 5,100,036 | 3/1992 | Rogers et al. | 224/193 |
| 5,193,725 | 3/1993 | Radocy | 224/197 |
| 5,265,781 | 11/1993 | Nichols | 224/911 |

*Primary Examiner*—Henry J. Recla
*Assistant Examiner*—Gregory M. Vidovich
*Attorney, Agent, or Firm*—Head & Johnson

[57] ABSTRACT

A variable position handgun holster having a belt plate securable to a belt. A back plate is generally parallel to the belt plate and a holster receptacle receives a handgun. The back plate may be adjusted longitudinally with respect to the belt plate. The receptacle may be adjusted with respect to the back plate radially about an axis point connecting the back plate to the receptacle. The back plate may also be adjusted with respect to the belt plate about an axis transverse to the belt plate. The back plate may also be adjusted with respect to the belt plate about a longitudinal axis passing through the belt plate.

16 Claims, 5 Drawing Sheets

VARIABLE POSITION HANDGUN HOLSTER

BACKGROUND OF THE INVENTION

1. Field of the Invention

The present invention pertains to a handgun holster which may be adjusted and then set in a variety of positions to accept various types and sizes of handguns.

2. Prior Art

While handgun holsters that attach to a belt are well known, generally the holsters will be made for either a right side or a left side, but will not accommodate both. There is a need, therefore, for a reversible handgun holster that may be used for either the right side or the left side.

While various holsters have been made heretofore which have provision for locking and retaining a handgun in place, generally these retention mechanisms and the holsters are made for a specific gun model. There is a need to produce a handgun holster with accompanying retention mechanism that will accept various sizes and various models of handguns.

There is additionally a need for a handgun holster that will receive and retain handguns with various barrel lengths.

Due to the varying heights of the user and the positioning of his or her belt, there is a need to provide a handgun holster so that the receptacle will be adjustable vertically with respect to the belt.

It is additionally desirable to provide a handgun holster where the handgun receptacle may be adjusted with respect to the holster radially about a center axis point connecting the receptacle to the holster.

It is additionally desirable to provide a handgun holster wherein the gun receptacle or body is adjustable with respect to the holster about an axis transverse to the holster. Accordingly, the gun may be spaced from the belt of the user at a desirable position for ease of use.

It is additionally desirable to provide a handgun holster wherein the handgun receptacle may be adjusted about a longitudinal axis passing through the receptacle.

Accordingly, it is a principal object and purpose of the present invention to provide a handgun holster which is modular having a number of replaceable and reversible elements so that a right hand or left hand model may be incorporated into one device.

It is a further object and purpose of the present invention to provide a handgun holster having a retention mechanism which will receive and secure handguns of various sizes and dimensions.

It is a further object and purpose of the present invention to provide a variable position handgun holster that will receive and retain handguns with various barrel lengths.

It is a further object and purpose of the present invention to provide a variable position handgun holster that will have a longitudinal adjustment, a radial adjustment, a spacing adjustment and a pitch adjustment, all in a single holster device.

SUMMARY OF THE INVENTION

The present invention provides a variable position handgun holster that may be secured to a belt. The holster device of the present invention will receive and lock into place a handgun. The holster device includes a belt plate having a belt loop so that a belt passing therethrough will be generally perpendicular.

A back plate is generally perpendicular to the belt plate and is secured thereto through a pair of upper jacking screws and a lower jacking screw. A holster body or receptacle having an open channel will receive and retain the handgun. The body or receptacle is secured to the back plate and may be moved longitudinally with respect to the back plate. Stated another way, the body or receptacle may be moved perpendicularly to the belt loop.

The holster receptacle may also be adjusted with respect to the back plate radially about the lower jacking screw which acts as a center axis point. An angle adjustment screw passes through the holster receptacle and then through arcuate slot in the back plate. Accordingly, the position of the receptacle and the handgun therein may be varied.

The back plate accommodates an additional adjustment with respect to the belt plate about an axis transverse to the belt plate. With the lower jacking screw remaining in place, the upper jacking screws may be rotated to either increase or decrease the spacing between the back plate and the belt plate at the upper jacking screws.

A further adjustment may be made of the back plate with respect to the belt plate about a longitudinal axis passing through the back plate. Stated another way, the back plate may be adjusted with respect to the belt plate about an axis perpendicular to the belt. The axis will pass through the lower jacking screw. By adjusting one of the upper jacking screws in one direction and adjusting the other jacking screw in the other direction, a tilt will be provided to the back plate and the receptacle secured thereto.

A pair of opposed, parallel slide bars extend from the receptacle and terminate in a cup. The slide bars are secured to the receptacles by a pair of threaded bolts. Accordingly, the cup may be positioned to accommodate handguns having various barrel lengths.

The handgun holster also includes a mechanism to retain or secure the handgun in the body or receptacle when not in use. A pair of opposed retention fingers each have threaded openings to receive a threaded shaft. A center adjustment wheel extending radially from the shaft acts as a turnbuckle. Rotating the turnbuckle in a first direction increases the tension between the tension fingers and the handgun. Opposite, counterclockwise rotation of the adjustment wheel will decrease the tension between the retention fingers and the handgun.

BRIEF DESCRIPTION OF THE DRAWINGS

FIG. 5 is a

DETAILED DESCRIPTION OF THE PREFERRED EMBODIMENT

Figure 1:
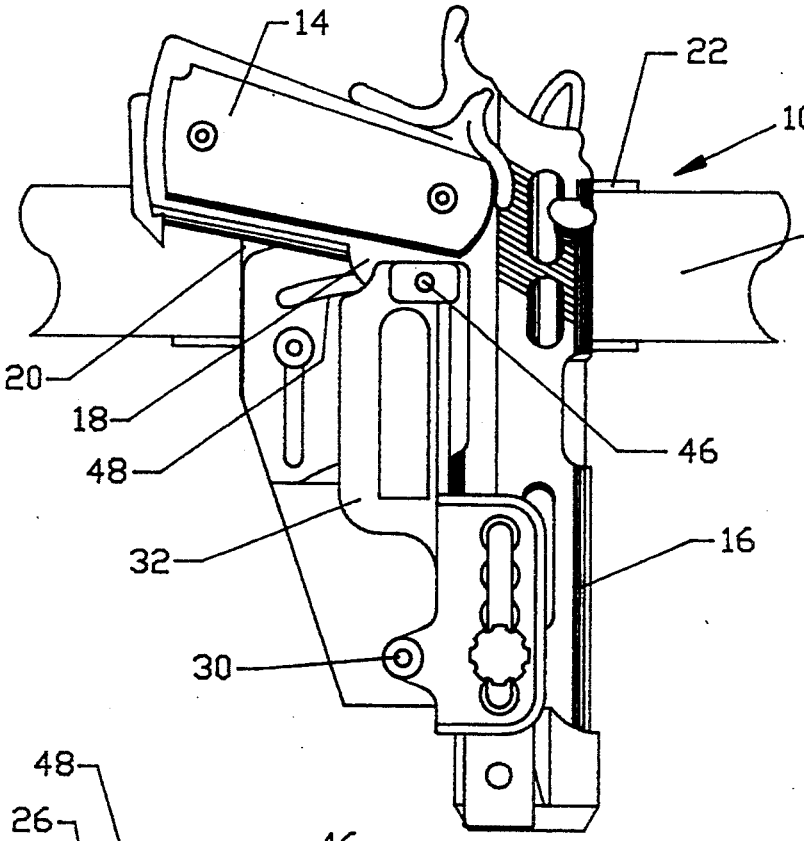
FIG. 1 is a perspective view of a variable position handgun holster with a belt secured thereto.

Referring to the drawings in detail, FIG. 1 illustrates a perspective view of a variable position handgun holster 10 that may be secured to a belt 12 (a portion of which is seen in FIG. 1). A handgun 14 is shown received in and locked in place in the handgun holster in FIG. 1. As will be appreciated, the handgun 14 may be of various dimensions but will generally include a barrel 16 and a trigger mechanism 18.

Figure 2:
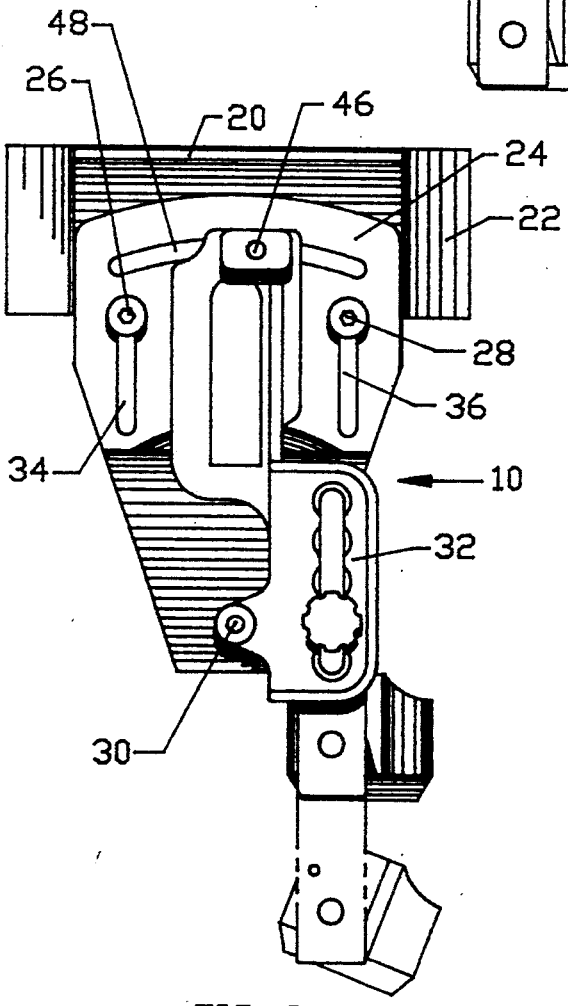
FIG. 2 is a perspective view of the variable position handgun holster shown in FIG. 1 with the handgun removed.

FIG. 2 depicts the handgun holster device 10 apart from the belt and with the handgun 14 removed therefrom. The holster 10 includes a belt plate 20 having a belt loop 22, so that a belt passing therethrough will be generally perpendicular to the belt plate 20. The rear side of the belt plate 20 (not shown in FIGS. 1 or 2) would rest against the upper leg of the handgun shooter (not shown). The belt loop portion 22 of the belt loop 20 may be slightly arcuate to more readily fit the waist of the marksman.

The handgun holster device 10 also includes a back plate 24 which is generally parallel to the belt plate. The back plate 24 is secured to the belt plate 20 through a pair of upper jacking screws 26 and 28 and a lower jacking screw 30. These screws pass through both the back plate 24 and through the belt plate 20 and are secured by nuts or otherwise secured to the belt plate.

The back plate 24 is secured to a holster body or receptacle 32 which will receive the handgun.. Movement of the back plate will, thus, move the receptacle. The back plate 24 and body or receptacle 32 may be moved longitudinally with respect to the belt plate. Stated another way, the body or receptacle 32 may be moved perpendicularly to the belt loop 22.

The upper jacking screws 26 and 28 pass through parallel slots 34 and 36 in the back plate and thereafter through the belt plate. The lower jacking screw 30 passes through an opening 38 in the back plate and thereafter through a slot 40 in the belt plate. The back plate is, thus, secured to the belt plate in three places.

Each upper jacking screw 26 and 28 may be provided with a snap ring 42 located between the back plate and belt plate. The back plate 24 may thus be spaced from the belt plate as will be described herein.

Depending upon the height of the handgun marksman, the positioning of his or her belt and the preference of the marksman, the handgun 14 may be positioned at a variety of heights.

Figure 3:
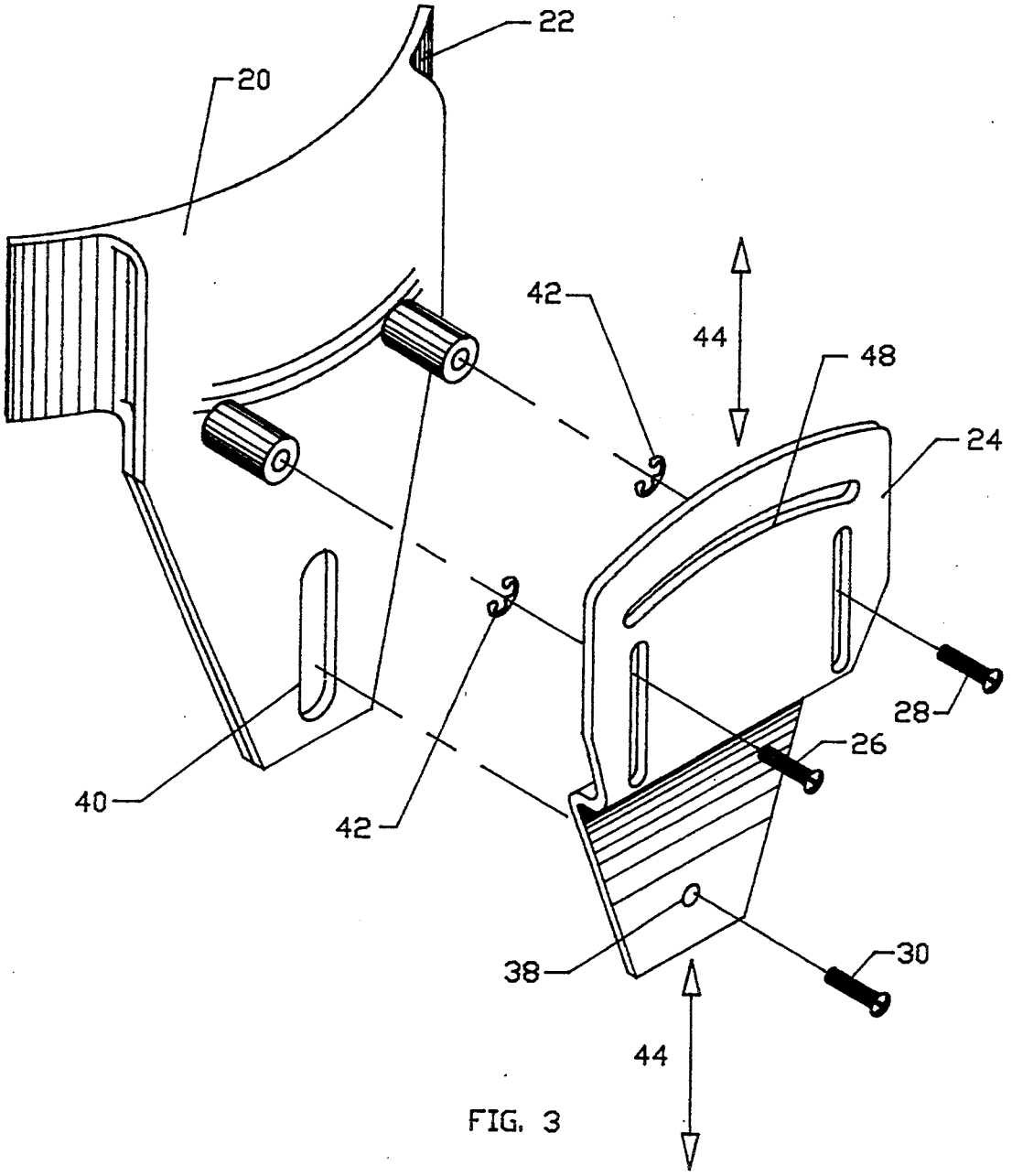
FIG. 3 is an exploded view of a belt plate and back plate of the variable position handgun holster shown in FIG. 1.

The longitudinal movement of the back plate and accompanying receptacle may be seen in FIG. 3. For ease of illustration, the belt plate 20 is shown separated from the back plate 24. Arrows 44 illustrate the possible longitudinal movements of the back plate 24 with respect to the belt plate 20. The lower jacking screw 30, thus, acts as a height adjustment screw. When the lower jacking screw 30 is tightened, the back plate is locked in place with respect to the plate.

Returning to a consideration of FIGS. 1 and 2, the holster receptacle 32 may also be adjusted with respect to the back plate 24 radially about the lower jacking screw 30 which acts as a center point or axis. The axis is perpendicular to both the belt and the belt plate 20.

Figure 4:
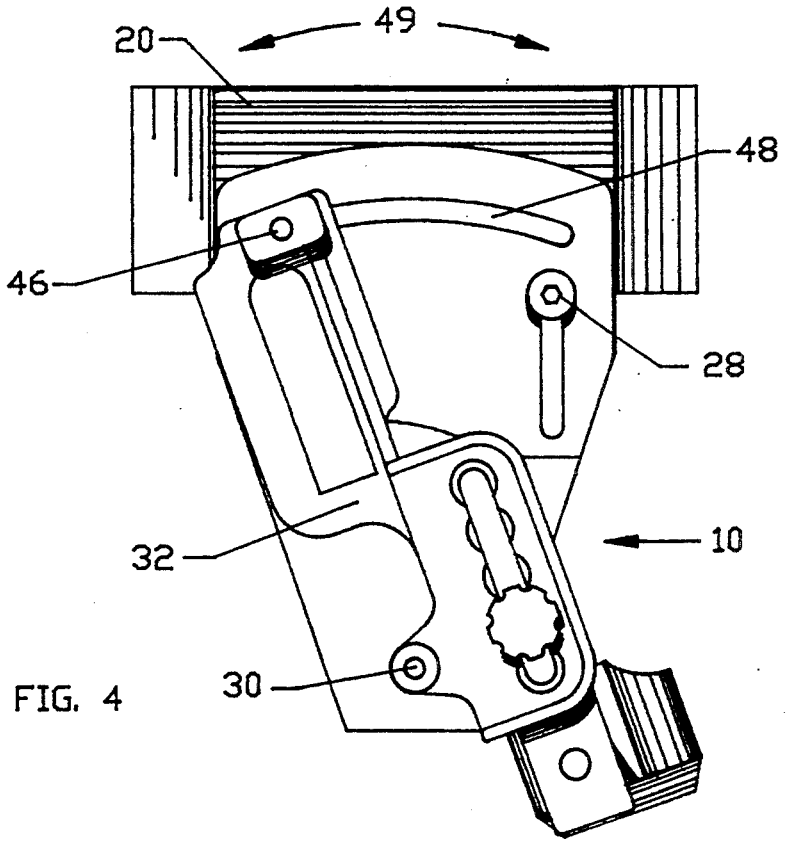
FIG. 4 is a perspective view of the variable position handgun holster showing alternate positioning of the body or receptacle with respect to the back plate.
Figure 5:
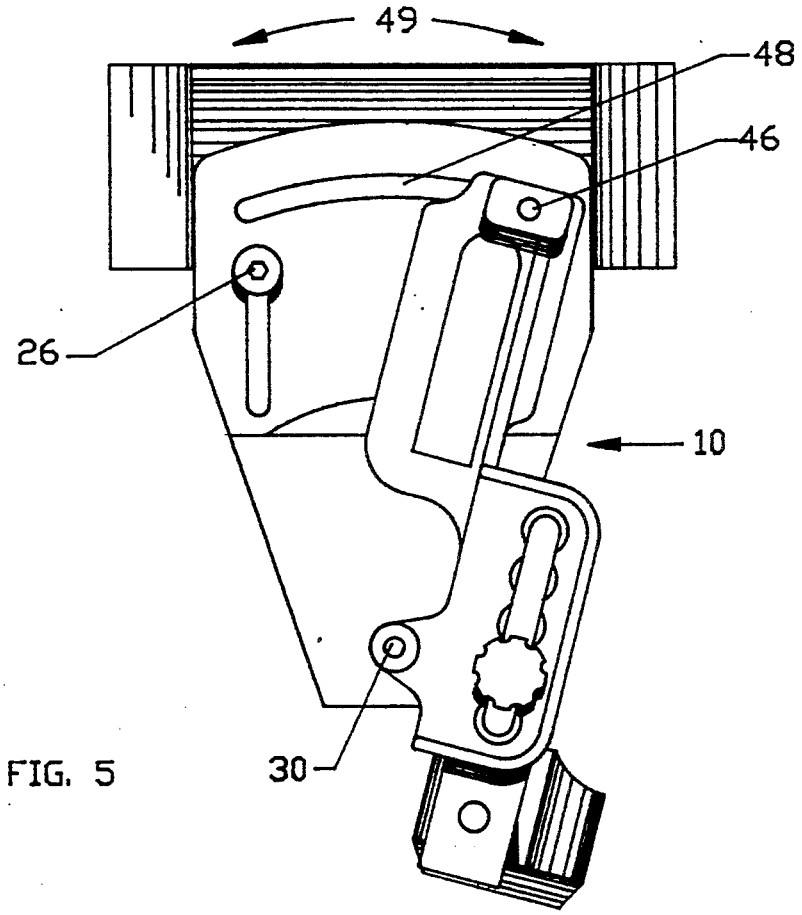

As best seen in FIGS. 4 and 5, an angle adjustment screw 46 passes through the holster body or receptacle 32 and then through an arcuate slot 48 in the back plate 24. The axis of the arcuate slot is at the lower jacking screw 30. Accordingly, the position of the holster receptacle 32 and the handgun maybe varied as shown by arrows 49.

The back plate 24 accommodates an additional adjustment with respect to the belt plate 20 about an axis transverse to the belt plate.

Figure 6:
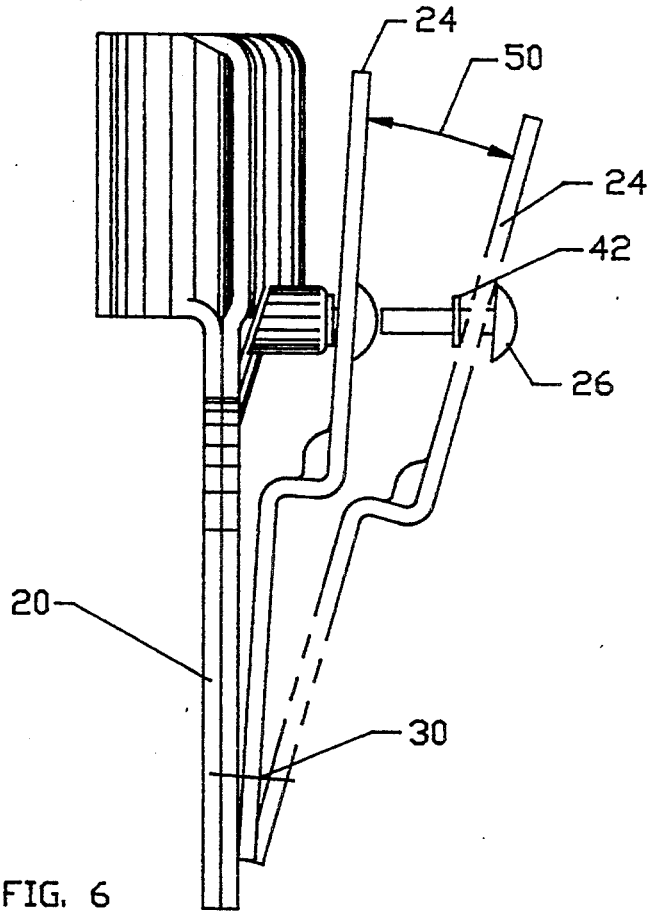
FIG. 6 is a side view of the belt plate and back plate of the variable position handgun shown in FIG. 1.

FIG. 6 illustrates a side view of the belt plate and back plate with the receptacle and other elements of the device removed. The back plate 24 is adjustable between the position seen and that shown by the dashed lines. With the lower jacking screw 30 remaining secured in place, the upper jacking screws 26 and 28 may be rotated to either increase or decrease the spacing between the back plate and the belt plate at the upper jacking screws 26 and 28. Accordingly, the receptacle attached to the back plate will also adjust its position. Arrow 50 illustrates the adjustment of the back plate 24 radially with respect to the belt plate about a longitudinal axis parallel to the back plate. The axis would be located through the lower jacking screw. Since the body or receptacle 32 is secured to the back plate, the receptacle will change position.

A further adjustment may be made of the back plate with respect to the belt plate about a longitudinal axis passing in the plane the back plate through the lower jacking screw. Stated another way, the back plate 24 may be adjusted with respect to the belt plate 20 about an axis perpendicular or at a right angle to the belt loop. The axis for this movement will pass through the lower jacking screw 30.

Figure 7:
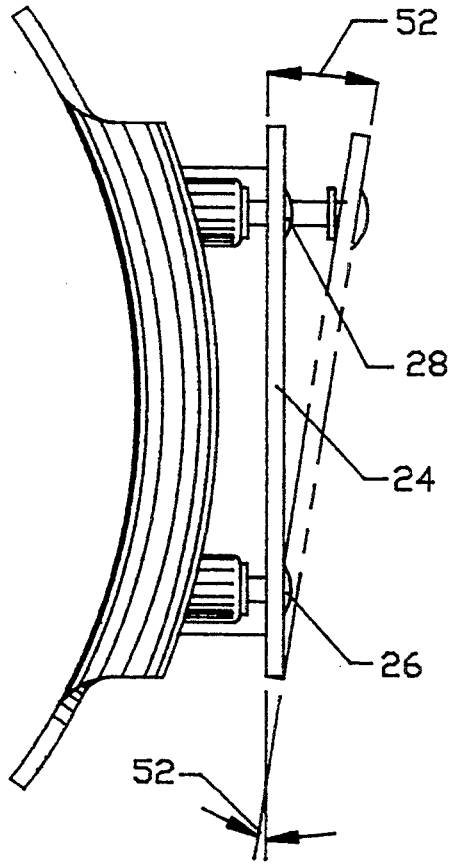
FIG. 7 is a top view of the back plate and belt plate of the variable position handgun holster shown in FIG. 1.

FIG. 7 illustrates the adjustment as shown by arrows 52. By adjusting one of the upper jacking screws 26 or 28 in one direction and adjusting the other jacking screw in the other direction, a tilt will be provided to the back plate. Since the body or receptacle is secured to the back plate, a handgun placed in the receptacle will have the same tilt.

It will be appreciated that each of these adjustments may be made to arrive at an infinite number of positions for the handgun held in the handgun holster 10.

Figure 8:
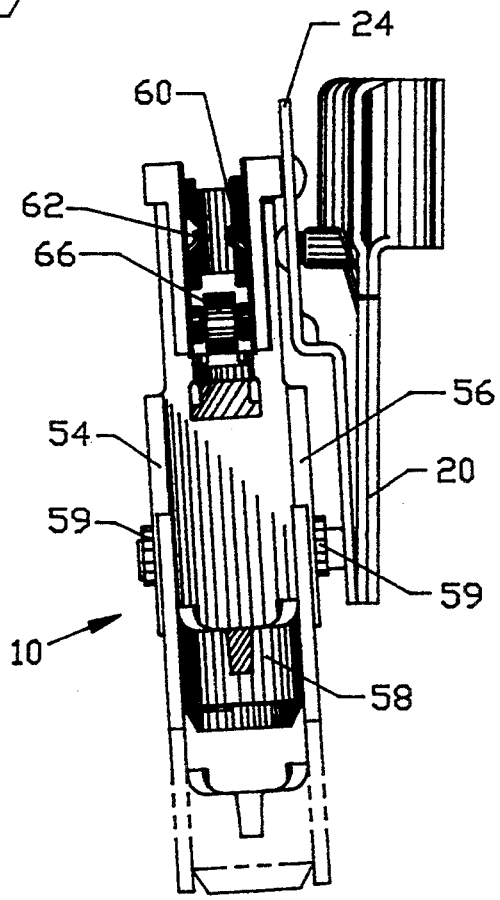
FIG. 8 is a side view of the variable position handgun holster shown in FIG. 1.

FIG. 8 illustrates the holster without the handgun inserted. A pair of opposed, parallel slide bars 54 and 56 extend from the receptacle 32 and terminate in a cup 58. The slide bars are secured to the receptacle by threaded bolts having knobs 59. The cup 58 may be fastened rigidly between the slide bars or pivotally attached between the slide bars through slots on receptacle 32 as seen in FIG. 2.

The handgun holster 10 of the present invention also includes a mechanism to retain or secure the trigger mechanism 18 of the handgun 14 in the receptacle when not in use. A pair of opposed retention fingers 60 and 62 each have threaded openings to receive a threaded shaft 64 therein. A center or tension adjustment wheel 66 extending radially from the shaft 64 acts as a turnbuckle. Rotating the turnbuckle in a counter-clockwise direction increases the tension between the retention fingers and the trigger mechanism 18 of the handgun, thus increasing the holding force on the firearm. Opposite, clockwise rotation of the adjustment wheel 66 will decrease the tension between the retention of the firearm, thereby decreasing the holding force on the firearm.

Figure 9:
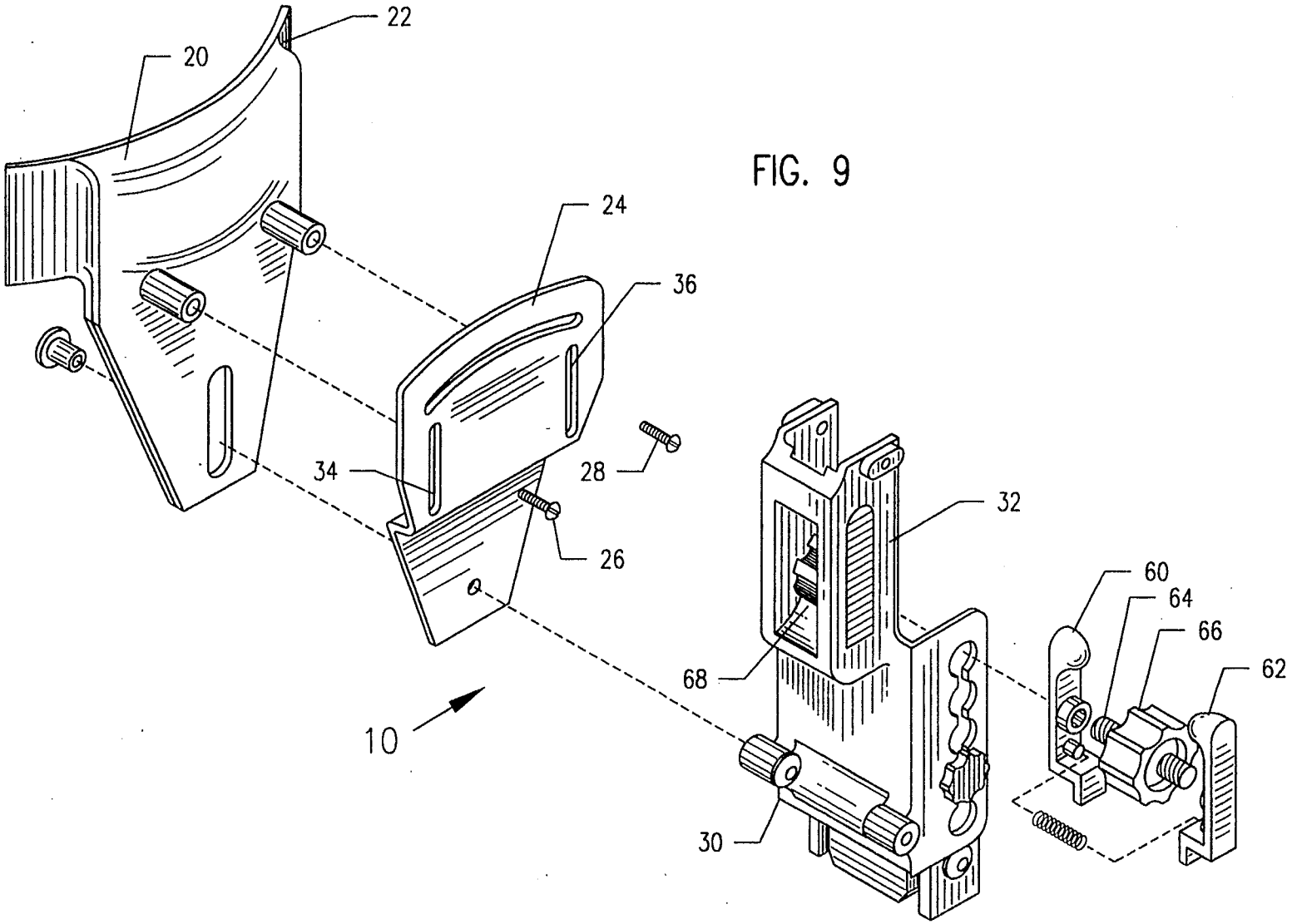
FIG. 9 is an exploded view of the variable position handgun holster shown in FIG. 1.

FIG. 9 shows an exploded view of the device for ease of illustration and comprehension. The center or tension wheel 66 is readily and quickly accessible through a recess 68 in receptacle 32. Accordingly, it will be simple for a marksman to either increase or decrease the tension by rotation of the center or tension wheel with a single finger.

To utilize the device, the handgun is removed from the device and the belt and holster are secured in the appropriate position on the marksman. The longitudinal adjustment is initially made. The lower jacking screw is loosened. The back plate is slidably moved to the desired position through slots 34, 36 and 40 and the lower screws tightened.

The barrel length adjustment may be made next. The threaded bolts and knobs 59 are loosened and the slide bars 54 and 56 adjusted to the length of the barrel of the handgun. The threaded bolts are thereafter tightened in place. The cup may be pivotal to allow easier insertion or removal of the handgun or may be rigidly secured to the bars.

The holster receptacle may then be adjusted radially with respect to the back plate. The angle adjustment screw 46 is loosened and the receptacle moved about arcuate slot 48. When positioned, angle adjustment screw 46 is tightened.

The spacing adjustment and tilt adjustment may thereafter be made. The upper jacking screws 26 and 28 are loosened to increase the distance of the receptacle from the body and tightened to decrease the distance from the body. The tilt adjustment may also be made by tightening one upper jacking screw while loosening the other.

It will also be appreciated that the receptacle or body 32 may be removed and reversed so that the open side is reversed. The device will, therefore, accommodate right or left hand use.

Whereas, the present invention has been described in relation to the drawings attached hereto, it should be understood that other and further modifications, apart from those shown or suggested herein, may be made within the spirit and scope of this invention.

What is claimed is:

1. A variable position handgun holster having a belt plate securable to a belt, which holster comprises:

a. a back plate generally parallel to said belt plate;

b. a holster receptacle for receipt of a handgun;

c. means to adjust said back plate longitudinally with respect to said belt plate;

d. means to adjust said receptacle with respect to said back plate radially about a center point connecting said back plate to said belt plate and said receptacle;

e. means to adjust said back plate radially with respect to said belt plate about a horizontal axis parallel to said belt plate and passing through said center point; and f. means to radially adjust said back plate with respect to said belt plate about a longitudinal axis passing through the plane of said back plate and through said center point.

2. A variable position handgun holster as set forth in claim 1 wherein said receptacle includes a pair of opposed, parallel slide bars and a cup removably secured therebetween for receipt of the barrel end of said handgun, and means to adjust said slide bars longitudinally to adjust for barrel length.

3. A variable position handgun holster as set forth in claim 1 wherein said cup is pivotally attached to said slide bars.

4. A variable position handgun holster as set forth in claim 1 wherein said receptacle has an open channel and wherein said receptacle is removable from said back plate and reversible to accommodate a left or right handed user.

5. A variable position handgun holster as set forth in claim 1 including means to retain said handgun in said receptacle.

6. A variable position handgun holster as set forth in claim 1 wherein said means to adjust said back plate longitudinally with respect to said belt plate includes a plurality of fasteners receivable through at least one slot in each of said back plate and belt plate.

7. A variable position handgun holster as set forth in claim 1 wherein said means to adjust said receptacle with respect to said back plate radially includes at least one fastener receivable through an arcuate slot in said back plate and secured to said receptacle, so that said receptacle may be positioned and then secured with said fastener.

8. A variable position handgun holster as set forth in claim 1 wherein said means to adjust said back plate radially with respect to said belt plate about said horizontal axis parallel to said belt plate and passing through said center point includes means to increase or decrease spacing between said back plate and said belt plate.

9. A variable position handgun holster as set forth in claim 1 wherein said means to radially adjust said back plate with respect to said belt plate about said longitudinal axis passing through the plane of said back plate and through said center point includes a pair of fasteners wherein loosening one of said fasteners will increase the space and tightening will decrease the space between said back plate and said belt plate.

10. A variable position handgun holster having a belt plate securable to a belt, which holster comprises:

a. a back plate generally parallel to said belt plate;

b. a holster receptacle for receipt of a handgun, said belt plate, back plate and receptacle each having a centrally located center point thereon wherein said belt plate is connected to said back plate and said receptacle is connected to said back plate at said center points;

c. means to adjust said back plate radially with respect to said belt plate about a horizontal axis parallel to said belt plate and passing through said center point connecting said back plate and said belt plate; and d. means to retain said handgun in said receptacle.

11. A variable position handgun holster having a belt plate securable to a belt which holster comprises:

a. a back plate generally parallel to said belt plate;

b. a holster receptacle for receipt of a handgun, said belt plate, back plate and receptacle each having a centrally located center point thereon having means for connecting said back plate to said belt plate and said receptacle;

c. means to radially adjust said back plate with respect to said belt plate about a longitudinal axis passing through the plane of said back plate and through said center point; and d. means to retain said handgun in said receptacle.

12. A variable position handgun holster having a belt plate securable to a belt, which holster comprises:

a. a back plate generally parallel to said belt plate;

b. a holster receptacle for receipt of a handgun;

c. means to adjust said back plate longitudinally with respect to said belt plate; and d. means to adjust said back plate radially about a horizontal axis parallel to said belt plate and passing through a center point connecting said back plate to said belt plate and said receptacle.

13. A variable position handgun holster having a belt plate securable to a belt, which holster comprises:

a. a back plate generally parallel to said belt plate;

b. a holster receptacle for receipt of a handgun;

c. means to adjust said back plate longitudinally with respect to said belt plate; and d. means to radially adjust said back plate with respect to said belt plate about a longitudinal axis passing through the plane of said back plate and through a center point connecting said back plate to said belt plate and said receptacle.

14. A variable position handgun holster having a belt plate securable to a belt which holster comprises:

a. back plate generally parallel to said belt plate;

b. a holster receptacle for receipt of a handgun;

c. means to adjust said receptacle with respect to said back plate radially about a center point connecting said back plate to said belt plate and said receptacle; and d. means to adjust said back plate radially with respect to said belt plate about a horizontal axis parallel to said belt plate and passing through said center point.

15. A variable position handgun holster having a belt plate securable to a belt, which holster comprises:

a. a back plate generally parallel to said belt plate;

b. a holster receptacle for receipt of a handgun;

c. means to adjust said receptacle with respect to said back plate radially about a center point connecting said back plate to said belt plate and said receptacle; and d. means to radially adjust said back plate with respect to said belt plate about a longitudinal axis passing through the plane of said back plate and through said center point.

16. A variable position handgun holster having a belt plate securable to a belt, which holster comprises:

a. a back plate generally parallel to said belt plate;

b. a holster receptacle for receipt of a handgun;

c. means to adjust said back plate radially with respect to said belt plate about a horizontal axis parallel to said belt plate and passing through a center point connecting said back plate to said belt plate and said receptacle; and d. means to radially adjust said back plate with respect to said belt plate about a longitudinal axis passing through the plane of said back plate and through said center point.

* * * * *